US007866243B2

(12) United States Patent
DiPietro

(10) Patent No.: US 7,866,243 B2
(45) Date of Patent: Jan. 11, 2011

(54) SLICER

(75) Inventor: Dean DiPietro, Brooklyn, NY (US)

(73) Assignee: Helen of Troy Limited, St. Michael (BB)

( * ) Notice: Subject to any disclaimer, the term of this patent is extended or adjusted under 35 U.S.C. 154(b) by 0 days.

(21) Appl. No.: 12/381,964

(22) Filed: Mar. 18, 2009

(65) Prior Publication Data

US 2009/0178532 A1 Jul. 16, 2009

Related U.S. Application Data

(62) Division of application No. 11/591,255, filed on Oct. 31, 2006, now Pat. No. 7,694,615.

(51) Int. Cl.
*B26D 1/02* (2006.01)

(52) U.S. Cl. ..... 83/856; 83/392; 83/932; 30/278; 30/279.6; 30/280; 30/286; 30/293

(58) Field of Classification Search ..... 83/856, 83/392, 437.2, 431, 437.1, 932, 425, 435.11, 83/466.1, 697, 698.11; 30/278, 279.4, 280, 30/279.6, 283, 286, 293, 114, 40.2, 279.2; D7/678, 693, 695, 696, 672–674; 99/537; 241/285.3, 285.2, 95

See application file for complete search history.

(56) References Cited

U.S. PATENT DOCUMENTS 4,038,892 A * 8/1977 Popeil ..... 83/874
4,573,387 A * 3/1986 Denter et al. ..... 83/856
4,733,588 A * 3/1988 Yamamoto ..... 83/857
5,636,442 A * 6/1997 Wain ..... 30/40.2
5,745,999 A * 5/1998 Zirkiev ..... 30/278
6,082,645 A * 7/2000 Himmighofen et al. ..... 241/168
6,732,622 B2 * 5/2004 Vincent ..... 83/247
7,621,207 B2 * 11/2009 Botsai et al. ..... 83/698.11

* cited by examiner

*Primary Examiner*—Boyer D. Ashley
*Assistant Examiner*—Omar Flores-Sánchez
(74) *Attorney, Agent, or Firm*—Seyfarth Shaw LLP

(57) ABSTRACT

A food slicer having a blade is disclosed having a runway for supporting food prior to cutting by the blade and a landing for supporting the blade and the food after being cut. The runway and landing are adjustable for selecting a thickness of a food slice. The runway and landing are simultaneously adjusted, by a single mechanism, so that the blade and runway are maintained generally parallel with respect to each other. The adjusting mechanism includes a plurality of rotatable cam portions that engage with respective portions on the runway and landing so that each of the runway and landing may be oppositely pivoted around an end to maintain the parallel relationship. The food slicer also includes on-board storage for inserts, such as julienning or cubing inserts. The storage is located on a bottom of the runway, which is pivoted upward for storage.

3 Claims, 12 Drawing Sheets

SLICER

REFERENCE TO PRIOR APPLICATION

The present application is a divisional of U.S. Ser. No. 11/591,255, filed Oct. 31, 2006, now U.S. Pat. No. 7,694,615 the filing priority of which is claimed and the entire disclosure of which is hereby incorporated by reference.

FIELD OF THE INVENTION

The invention relates to a food slicer, and, in particular, to a food slicer adjustable to select a thickness of food sliced and, more particularly, to a food slicer adjustable to maintain a runway and a landing in generally parallel relationship to produce food sliced with a substantially constant cross-section.

BACKGROUND

Food slicers of a type known as mandoline slicers are well known. Slicers of this type have a knife or blade having a blade body and a leading edge on the blade body for cutting food. The slicer is operated by directing a quantity of food in a direction toward the knife edge to be cut. Under ideal circumstances, the planar blade body would be arranged generally parallel with the direction in which the food is moved.

A bulk quantity of food is typically placed on a support surface, often referred to as a runway, and then slid across the runway toward the blade edge. The blade is offset from the runway, and the offset distance provides a thickness or depth of the cut made in the food as it is pushed into the blade. After the food passes by the blade, the uncut portion passes above the blade and onto a landing, and the sliced portion passes below the blade and separates from the rest of the food bulk.

The blade edge, despite cutting through the food, provides a resistance force. For example, a straight blade edge that is perpendicular or transverse to the direction of cutting may require a relatively high force applied to the food. The straight blade makes a line contact across a square face of the food bulk, and the entire blade edge enters the food bulk at generally the same time. To ease the entrance of the blade into the food, it is known to set the blade edge at an angle from the direction of cutting. This allows a first portion of the blade to enter the food at the oblique angle, and the rest of the blade edge trails and enters subsequent to the first portion, thus requiring a lower initial force to begin a cut of the bulk food. However, the resistance between the blade and the food results in a force that tends to direct or push the food to one side of the slicer.

This issue may be remedied by providing a pair of blade edges, the blade edges set oblique to the direction of cutting but opposite to each other. For instance, the blade often is arranged with a pair of blade edges that form a V-shape, and food is directed toward the center of the intersection of the blade edges in the center of the blade. The lateral forces on the food as a result of the resistance from the blade passing through the food are balanced between the blade edges, each edge tending to force the food towards the other blade edge, directing the food inwardly towards the center of the blade.

In order to select a slice thickness, some mandoline slicers are adjustable. That is, the slicer is adjustable so that the offset between the blade and the runway may be selected. However, this adjustment presents a number of issues.

First, the plane of the blade may not remain parallel to the runway, instead tilting somewhat. This results in an increase in resistance, requiring the user to have to exert a greater force to overcome the resistance. In detail, if the blade edge is angled or tilted upward relative to the landing, the blade tends to pull the food downward. This downward pull causes greater friction or resistance between the food and the runway, and may compress the food as it passes towards the blade. This results in a slice in which the trailing portion gradually increases so that the cross-section of the slide is not even or constant. Conversely, a blade angled upward will cause the food to lift upward resulting in a slice where the trailing portion gradually decreases, and the slice again has an uneven cross-section.

Additional issues arise when the adjustable slicer includes a V-shaped blade. In order to match the V-shape of the blade, the runway has a V-shaped end. If the runway is simply tilted downward to increase the thickness of the cut portion, for instance, the offset between the blade edge and the runway varies from a maximum at the apex of the V-shapes to a minimum at the forward-most portion of the V-shapes.

Various attempts have been made to address these problems by adjusting the runway relative to a co-planar blade and landing so as to maintain the runway in a plane generally parallel to the blade. One example of such a slicer is shown in U.S. Pat. No. 6,732,622, to Vincent. The '622 patent shows a ramp, or runway, that is raised or lowered so that it generally remains parallel to a landing. The ramp is shifted by a pair of locking screws on the sides of a frame. The screws must be properly adjusted, relative to each other, or the ramp will end up tilted to one side. The slicer also requires a number of steps, as the screws must be loosened, the ramp shifted by eye to a desired position for a slice thickness, and then each screw must be tightened. This makes fine tuning of the slice thickness difficult. Furthermore, the ramp is secured via laterally extending pegs received in oblique holes so that the ramp actually moves horizontally relative to the blade edge, thus resulting in less precision with cutting.

Another design is shown in U.S. Pat. No. 5,765,572, to Kim. This system has a single adjusting nut, so it is easier to operate than the slicer of the '622 patent. However, the ramp or sizing plate shifts horizontally relative to the blade in the same manner as the '622 patent.

Accordingly, there has been a need for an improved mandoline-type food slicer.

SUMMARY

In accordance with an aspect of the present invention, a food slicer for slicing food advanced in a cutting direction is disclosed having a blade for cutting the food to form a slice thereof, the blade substantially defining a plane and secured on a landing, and the blade having a blade edge facing opposite the cutting direction, the landing receiving food thereon after it passes by the blade, a runway for supporting the food thereon prior to and as the food passes by the blade, and an adjustment mechanism for simultaneously moving the runway and landing to adjust a vertical offset between the blade edge and the runway to select a thickness of the food slice. The blade edge and a downstream edge of the runway may have a horizontal spacing, and the landing and runway may be adjustable so that the horizontal spacing remains generally constant. The horizontal alignment may include the blade edge and downstream edge being separated by a horizontal distance, the landing and runway being adjustable so that the horizontal distance remains generally constant.

The runway and landing may be pivotally adjustable. More specifically, the landing and runway may have respective decks, each preferably generally planar, and each of the decks are oppositely pivotable to adjust a distance between the blade on the landing and the runway. The runway may be pivotable about an upstream end while the landing is pivotable about a downstream end, together the landing and runway being adjustable so that the planes of the runway deck and the blade remain substantially parallel.

The food slicer may include a frame for supporting the runway and landing. The frame may include pivot stubs upstream of the blade, and the runway may include recesses for receiving the pivot stubs, together defining a pivot axis for the runway. The slicer may include an axle downstream of the blade, and the landing may include hooks positioned around the axle to define a pivot axis for the landing.

The adjustment mechanism may cooperate with both the runway and landing to simultaneously adjust the positions of each so that an offset between the blade and landing, or thickness for the food slice, may be selected. Preferably, the adjustment mechanism is rotatable to adjust the runway and landing positions. In some forms, the adjustment mechanism includes a first cam cooperating with the runway and a second cam cooperating with the landing, the cams being rotatable to pivot the runway and landing in opposite directions to select the offset between the blade edge and the runway.

Preferably, the vertical offset is generally constant in a direction lateral to the cutting direction so that the slice thickness is generally constant.

In another aspect, a food slicer is disclosed having a blade with a blade edge, a landing, a runway, and an adjustment mechanism for selecting a vertical offset between the blade edge and the runway to select a thickness of the food slice, the adjustment mechanism having at least a first cam portion for adjusting the vertical offset. The adjustment mechanism may include the first cam portion as well as a second cam portion, the cam portions respectively cooperating with the runway and landing for adjusting the vertical offset. The cam portions are rotated to adjust the relative position of the runway and landing to adjust the vertical offset for the thickness of food sliced. The cam portions pivot the runway and landing simultaneously relative to the slicer to adjust the vertical offset. Preferably, the offset is generally constant in a direction lateral to the cutting direction so that the slice thickness is generally constant.

In some forms, the adjustment mechanism includes a central portion on which the first cam portion and a second cams portion are positioned, the central portion being rotatable to rotate the first and second cam portions to pivot the runway and landing in opposite directions to select the offset between the blade edge and the runway. The landing may include a generally planar deck, the runway may include a generally planar deck, and the cam portions may pivot the landing and runway so that the runway deck and landing deck remain substantially parallel.

In another aspect, a food slicer is disclosed having a slicing blade oriented generally transverse to the cutting direction having a blade edge, a landing for receiving the food after the food passes over the blade edge, an insert, a runway for supporting the food prior to the food passing over the blade edge, the runway including structure for retaining the insert on a top side of the runway, the structure permitting removal of the insert therefrom for replacement of the insert, and a storage bay for storing the insert. The storage bay includes resiliently deflectable retention portions for releasably securing the insert in the storage bay. The storage bay is preferably located on a bottom portion of the food slicer, the bottom portion being movable relative to the food slicer to allow access to the storage bay from a top side of the food slicer. The insert may include a set of blades oriented generally orthogonal to the slicing blade, such as a julienne insert or a cubing insert.

In another aspect, a food slicer including an insert for cubing or julienning or the like is disclosed having a blade, a landing, and a runway for supporting the food prior to the food passing over the blade, the runway including structure for removably retaining the insert on a top side of the runway, and a storage bay for storing the insert on a bottom portion of the food slicer. The bottom portion is movable relative to the food slicer to allow access to the storage bay from a top side of the food. The bottom portion may be formed on, for instance, the landing or the runway.

DETAILED DESCRIPTION

Figure 1:
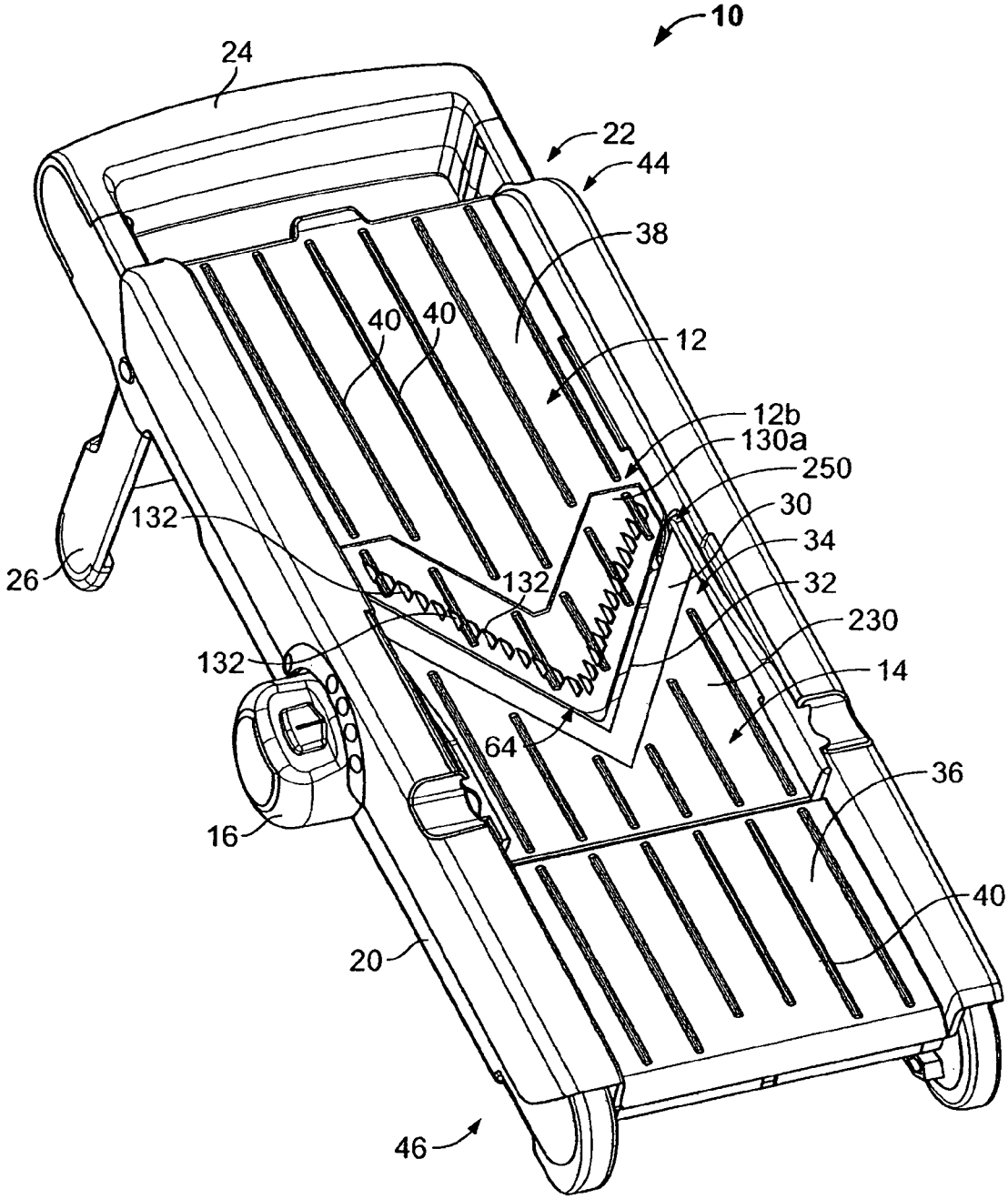
FIG. 1 is a perspective view of a slicer of the present invention disposed in a use configuration.

Referring initially to FIG. 1, a mandoline-type slicer 10 of the present invention is depicted. The slicer 10 has a runway 12 and a landing 14 that are tiltable by a single adjustment knob 16 positioned on the side of the slicer 10 so that a thickness T (see FIG. 7, e.g.) of a slice of food made by the slicer 10 may be selected. The runway 12 and landing 14 are adjusted simultaneously so that the runway 12 and landing 14 remain generally parallel before and after adjustment, resulting in a food slice thickness T that is substantially constant throughout the slice.

The slicer 10 includes a frame 20 supporting the runway 12 and landing 14. A rear end 22 of the frame 20 includes a handle 24 for ease of transport as well as for steadying the slicer 10 during use, and a stand 26 that is pivotally connected to the frame 20 so that the rear end 22 may be raised up during use of the slicer 10. Both the runway 12 and landing 14 are pivotally supported by the frame 20, as will be discussed in greater detail below, so that the runway 12 and landing 14 may be pivotally adjusted relative to the frame 20, as well as to each other, to permit selection of the slice thickness T for food being cut by the slicer 20.

Figure 4:
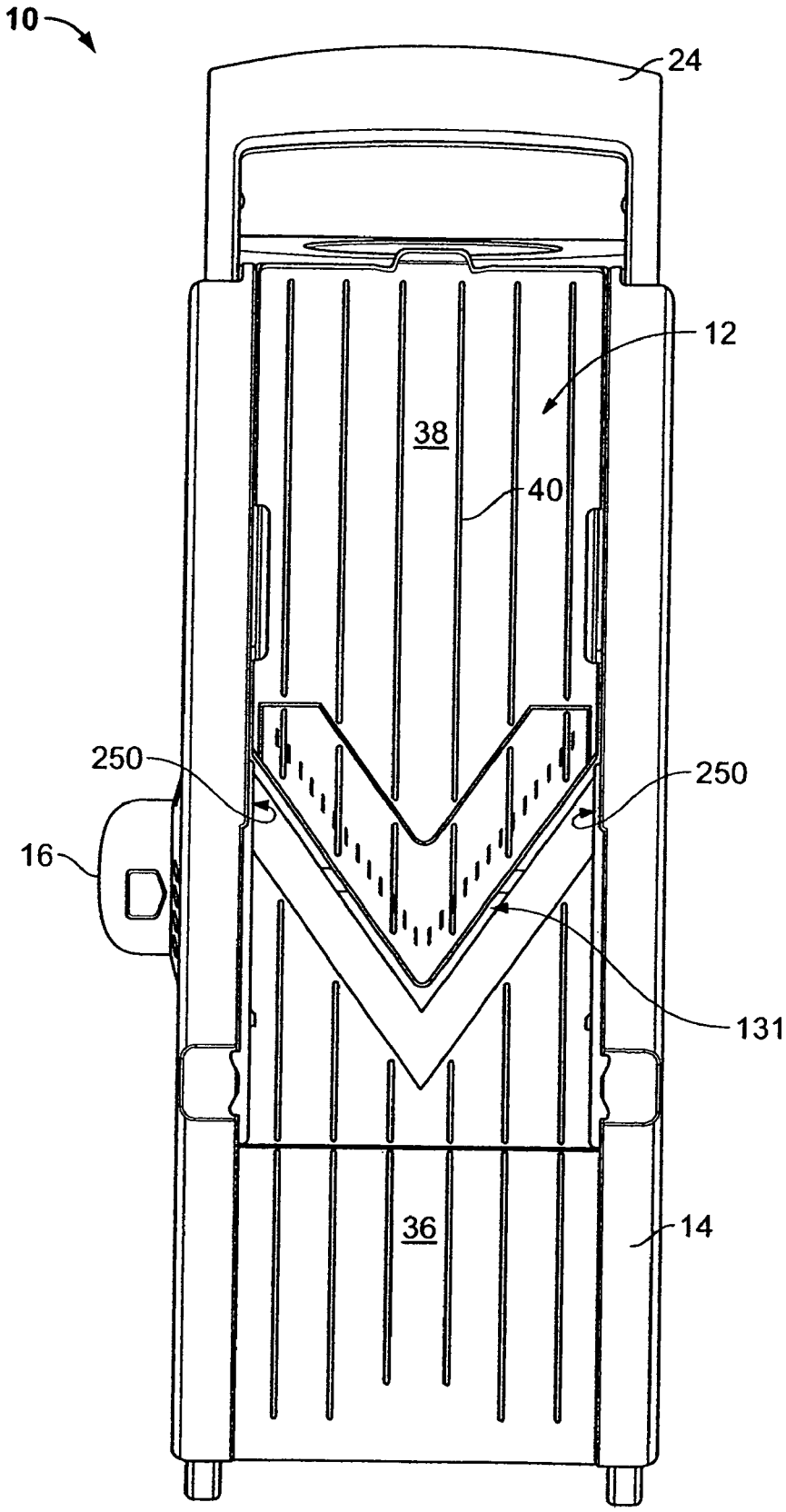
FIG. 4 is a top plan view of the slicer of FIG. 1.

The slicer 10 includes a V-shaped blade 30 having a blade edge 32 and being secured with the landing 14 on a top side thereof for use. The blade 30 is substantially a planar member secured on an upstream end 34 of a deck 36 of the landing 14. The landing deck 36 is also substantially planar and, preferably, substantially co-planar with the blade 30. The runway 12 also has a substantially planar deck 38 on which an amount of food to be sliced, referred to herein as a food bulk, is initially placed. Both the runway deck 38 and the landing deck 36 include upstanding ridges 40 which assist in moving the bulk food along the decks 36, 38 by preventing sticking and an 'airlock' condition during operation. It should be noted that the blade edge 32 is positioned relatively close to a downstream end 64 of the runway 12 and an insert 130 (described below), as best seen in FIG. 4, so there is a small horizontal distance 131 therebetween. During operation as described herein, the blade edge 32 remains generally close to the runway 12 and insert 130, separated horizontally by the small horizontal distance.

During operation, the food bulk placed on the runway deck 38 is advanced towards the blade edge 32. As a portion of the food bulk comes into contact with the blade edge 32, the blade 30 begins to cut into the food bulk to form a slice. Once the entire food bulk has passed by the blade edge 32, the slice is completed and is separated from the food bulk by passing underneath the blade 30.

Figure 2:
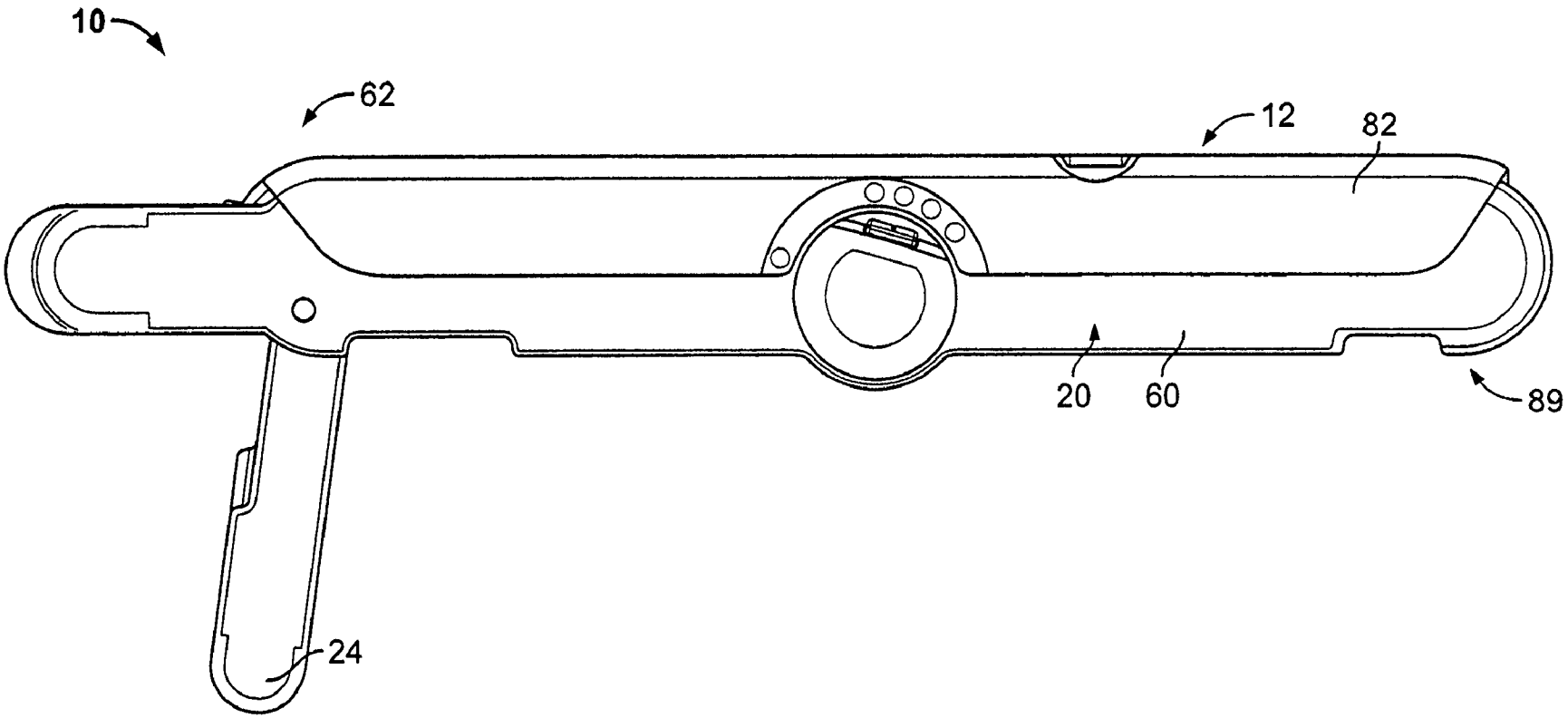
FIG. 2 is a side elevational view of the slicer of FIG. 1 as viewed from the left-hand side thereof.

To enable this operation, the blade edge 32 is positioned at the offset or thickness T (FIG. 7, e.g.) above that of the runway deck 38. For the sake of description, terms used herein such as height, up and down, horizontal and vertical, etc., are done so while disregarding the presence of the stand 26 and treating the frame 20 as being generally horizontally oriented, such as is shown in FIG. 2, the term downstream refers to the direction in which food is moved for cutting, and the term upstream refers to a direction opposite the direction for cutting the food bulk. The thickness T is the thickness of the slice of the food bulk made by the slicer 10.

Figure 3:
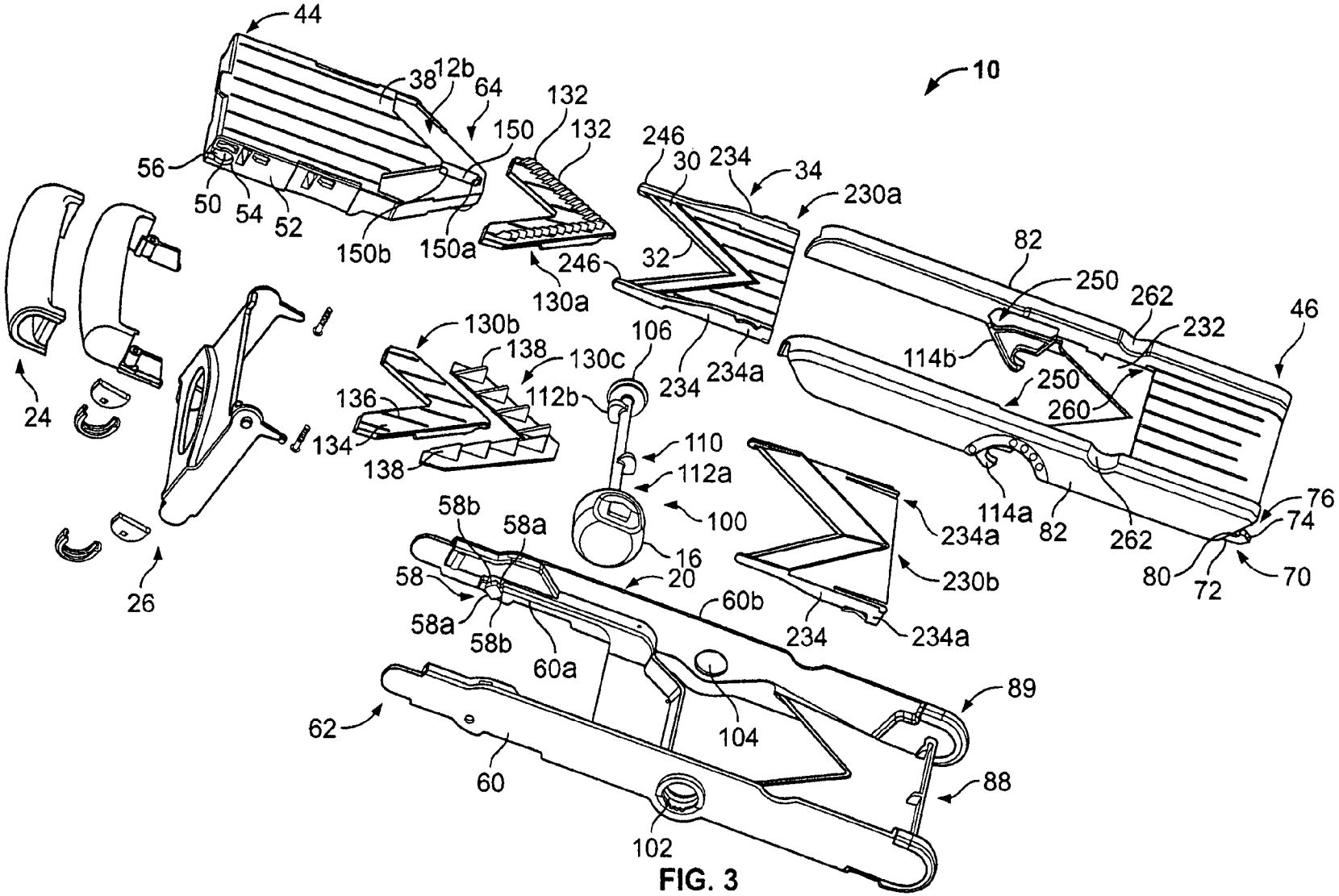
FIG. 3 is a reduced, exploded, perspective view of the slicer of FIG. 1.

Selection of a slice thickness T is made by rotating the adjustment knob 16 to pivot or rotate the runway 12 about its upstream end 44 and to rotate the landing 14 about its downstream end 46. As can be seen in FIG. 3, the runway upstream end 44 includes recesses 50 located on its outwardly facing sides 52. Each recess 50 has a partial circle-shaped portion 54 and an open slot 56 extending in the upstream direction. The recesses 50 form a pivot point or axis for the runway 12, around which the runway 12 is pivoted for slice thickness T selection.

To form this axis, the recesses 50 receive pivot stubs 58 formed on the frame 20. In greater detail, the frame 20 includes opposed frame sides 60 with interior surfaces 60*a*. The pivot stubs 58 are located on the interior surfaces 60*a* proximate an upstream end 62 of the frame 20, as can be seen in FIG. 3. The pivot stubs 58 are shaped so as to be somewhat circular, though truncated by two parallel chords. That is, the pivot stubs 58 each have two generally straight sides 58*a* that are connected by two arc portions 58*b*.

The shape of the pivot stubs 58 helps avoid the runway 12 inadvertently coming off the pivot stubs 58. The dimension between the arc portions 58*b* is greater than the width of the runway slot 56. In order for the recesses 50 to receive the stubs 58, or for the runway 12 to be removed from the stubs 58, the straight sides 58*a* must be generally aligned with the runway slot 56. To locate the recesses 50 on the pivot stubs 58, the runway 12 is oriented above the frame 20 with the slot 56 aligned with the recess sides 58*a* and then advanced until the stubs 58 are within the recess circle portion 54. The runway 12 is then rotated approximately 110° around the stubs 58 so that its downstream end 64 pivots towards the landing 14 to a position generally between the frame sides 60, as shown in FIG. 1.

As noted, the landing 14 is also rotatable around its downstream end 46 to adjust the landing 14 for slice thickness. In greater detail, the landing 14 is pivoted so that the thickness T or offset between the blade edge 32, secured on the landing deck 36, and the runway deck 38 is adjusted or selected. The landing downstream end 46 includes a pair of pivot hooks 70 (FIGS. 3 and 5) formed by an extension portion 72 and a barb portion 74 extending orthogonally from the extension portion 72 to define a pivot opening 76 between the barb portion 74 and an end 80 of a side frame 82 of the landing 14.

When the landing 14 is assembled with the frame 20, the hooks 70 receive a landing axle 88 located on the frame 20 near its downstream end 89, about which the landing 14 is rotated for selecting the slice thickness T. To assemble, the landing 14 is oriented so the pivot openings 76 may receive the landing axle 88 without the landing side frames 82 interfering with the frame sides 60, such as in a vertical orientation or an up-side down orientation with the pivot openings 76 of the hooks 70 facing downward. The landing 14 is advanced towards the landing axle 88 until the axle 88 is within the pivot openings 76, and then is rotated around the landing axle 88 to the assembled position. The landing side frames 82 are generally channel-shaped so that, when rotated to the assembled position, the frame sides 60 are partially received within the landing side frames 62, as shown in FIG. 2.

When the slicer 10 is assembled, each of the runway 12 and landing 14 is pivotable by the adjustment knob 16. Broadly speaking, the adjustment knob 16 is rotatable to pivot the runway 12 and landing 14 through a range of relative positions. The knob 16 may be rotated so that the runway 12 and landing are in a locked position, shown in FIG. 6, such as would be desirable for storage of the slicer 10. In a first use position, the runway 12 and landing 14 are in a nearly co-planar relationship so that a gap or the offset between the blade edge 32 and the runway 12 provides for a small thickness T1 for a slice of the food bulk, shown in FIG. 7. In comparing FIGS. 6 and 7, it can be seen that the thickness T1 of FIG. 7 is eliminated when the runway 12 and landing 14 are in the position of FIG. 6. At a second use position, shown in FIG. 9, the runway 12 and landing 14 are positioned with a relatively large thickness T3 for a slice of the food bulk between the blade edge 32 and the runway 12. The runway 12 and landing 14 may be positioned between these described positions for thicknesses intermediate thickness T1 and thickness T3, such as a thickness T2 as shown in FIG. 8. Additionally, the adjustment knob 16 may be rotated to so that the runway 12 and landing 14 are in a release position, enabling the runway 12 and landing to be lifted off and separated from the slicer 10, as would be desirable for cleaning purposes, as shown in FIG. 10.

To pivotally adjust the runway 12 and landing 14, the adjustment knob 16 is secured or integral with a cam axle 100, shown in FIG. 3. The adjustment knob 16 is assembled outboard and on a first frame side 60*a*, and the cam axle 100 extends into and through an opening 102 formed in the first frame side 60*a*. The cam axle 100 crosses from the first frame side 60*a* to a second frame side 60*b* that includes a recess or opening 104. An enlarged bearing portion 106 is formed on the cam axle 100 and is assembled with the opening 104. The cam axle 100 thus is rotatable within the openings 102 and 104.

Figure 5:
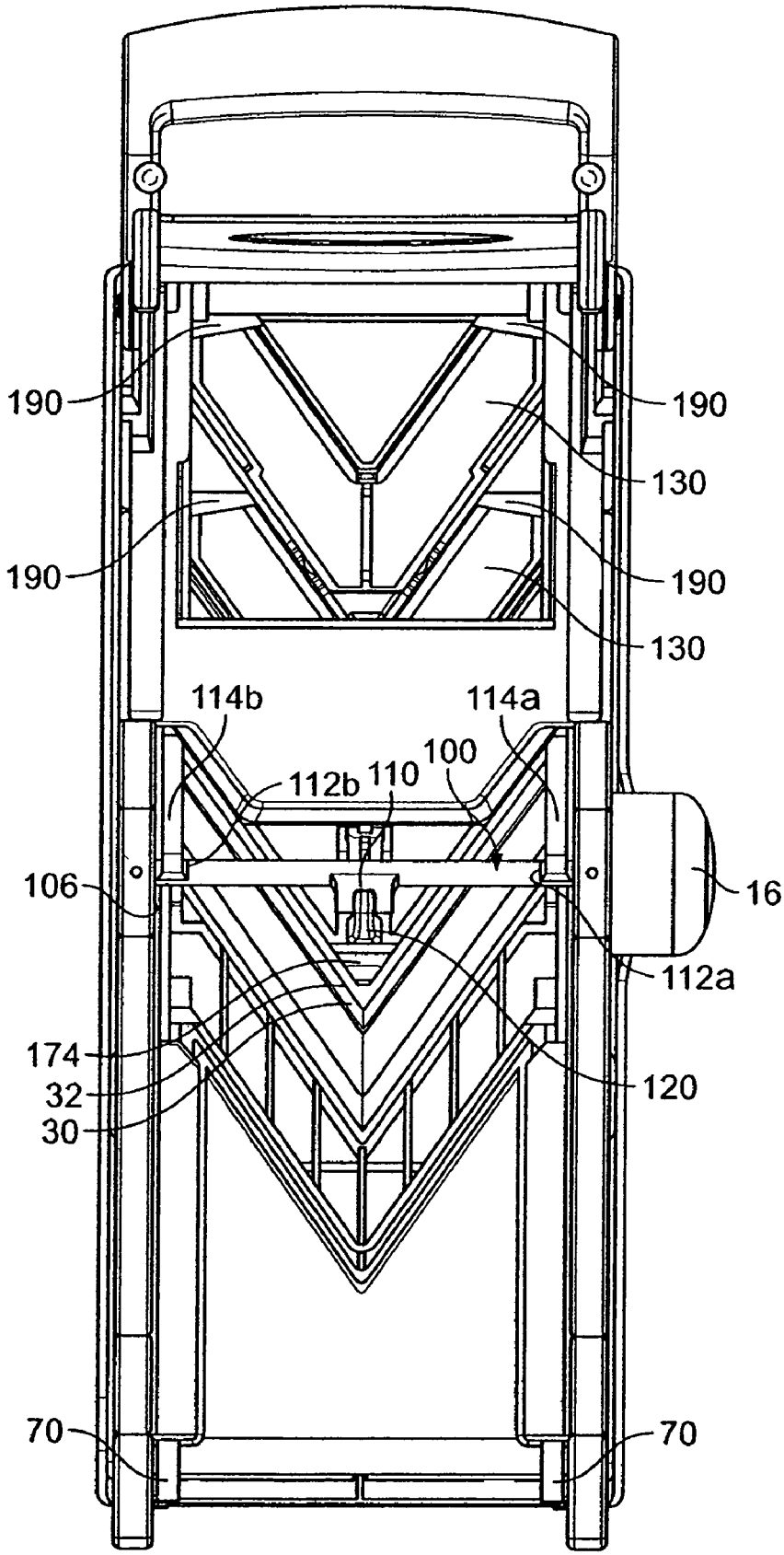
FIG. 5 is a bottom plan view of the slicer of FIG. 1.

The cam axle 100 includes a runway cam 110 and a pair of landing cams 112, the runway cam 110 engageable with the runway 12 while the landing cams 112 are engageable with the landing 14. The runway cam 110 is positioned generally in the center of the cam axle 100, while a first landing cam 112*a* is positioned proximate the adjustment knob 16 and a second landing cam 112*b* is positioned proximate the bearing portion 106. As can be seen in FIGS. 3 and 5, the landing 14 includes a pair of cam hooks 114 located generally along the landing frame sides 82. A first cam hook 114*a* is positioned proximate the adjustment knob 16 for receiving and cooperating with the first landing cam 112*a*, and a second cam hook 114*b* is positioned proximate the bearing portion 106 for receiving and cooperating with the second landing cam 112*b*. As the adjustment knob 16 is rotated, the landing cams 112*a*, 112*b* cooperate with the cam hooks 114*a*, 114*b* to pivotally raise the landing 14 to increase the thickness T of the slice and to pivotally lower the landing to decrease the thickness T of the slice, representatively shown in FIGS. 6-10.

Figure 11:
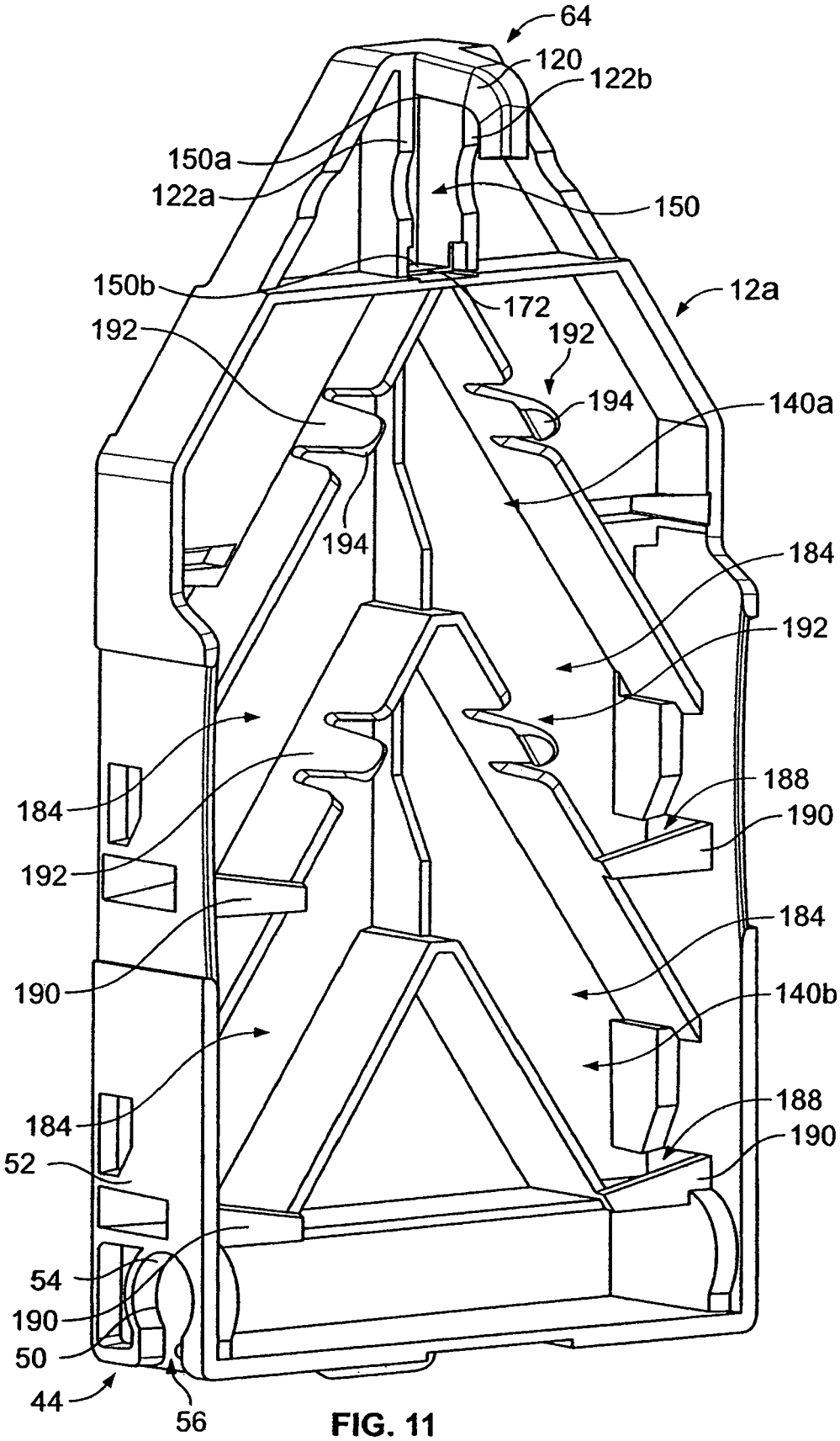
FIG. 11 is an enlarged perspective view of a bottom side of the runway having storage bays for interchangeable runway inserts.

The runway 12 includes structure for receiving and cooperating with the runway cam 110, best seen in FIG. 11. This structure includes a runway hook 120 positioned at the downstream end 64 of the runway 12 and a pair of cam surfaces 122*a* and 122*b* located on the bottom side of the runway 12 proximate the runway hook 120.

In operation, the adjustment knob 16 is simply rotated to pivotally adjust the position of the runway 12 and landing 14, the cooperating cam portions of the runway 12, landing 14, and cam axle 100 being programmed so that the amount of pivoting for the runway 12 and landing 14 adjust the thickness T of a slice of the food bulk while maintaining the planes of the runway 12 and the blade 30 in a substantially parallel relationship.

Figure 6:
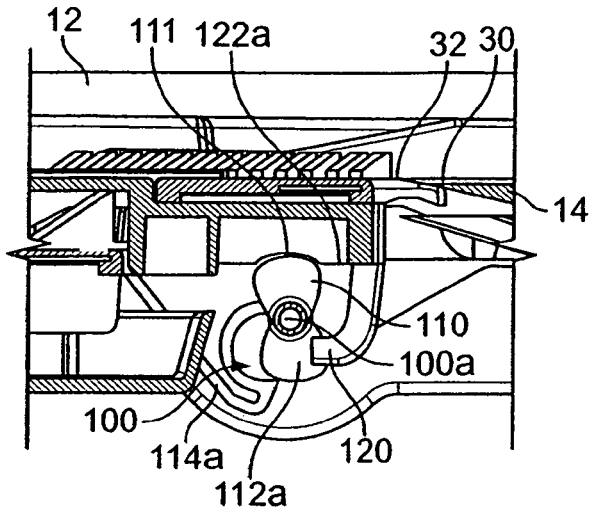
FIG. 6 is a fragmentary cross-sectional view of the cam assembly of the slicer of FIG. 1 in a locked position
Figure 7:
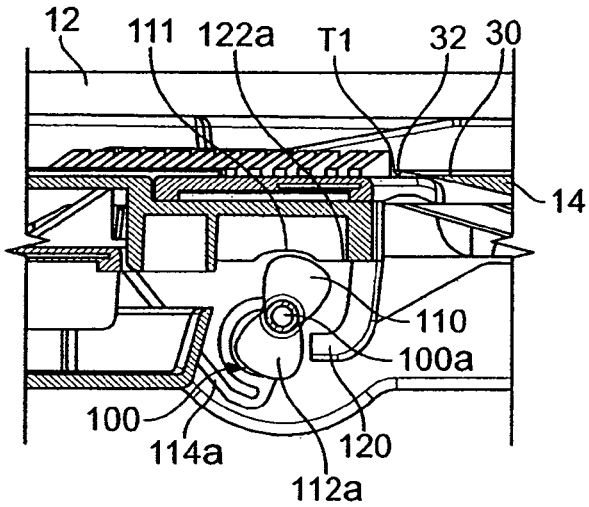
FIG. 7 is a view similar to FIG. 6 showing the cam assembly in a first use position.
Figure 8:
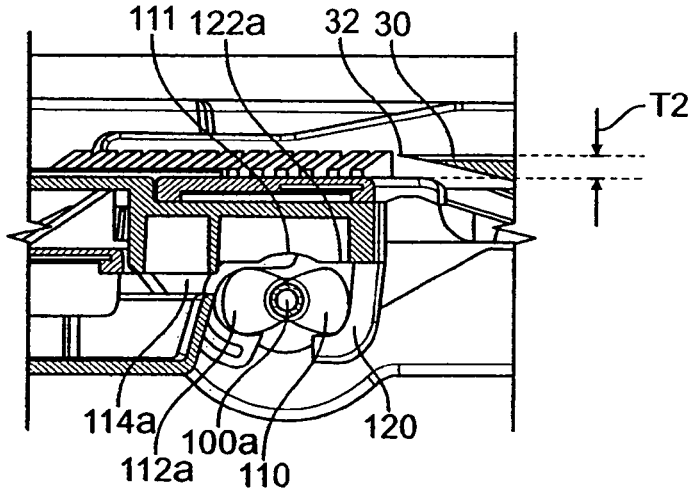
FIG. 8 is a view similar to FIGS. 6 and 7 showing the cam assembly in a second use position.

With specific reference to FIGS. 6-10, the cooperation of the cam axle 100 and cams 110, 112 thereon with the runway 12 and landing 14 can be seen. In FIG. 6, showing the slicer 10 in the locked position, the runway cam 110 is in an arcuate recess 111 that allows the rotation of the runway cam therein generally free movement, and the landing cam 112*a* coming into contact with the landing cam hook 114*a*. In this position, the landing cam 112*a* holds down and "locks" the landing 14. In FIG. 7, the cam axle 100 is shown in a first use position, rotated clockwise from FIG. 6, with the runway cam 110 still generally in the recess 111 and the landing cam 112*a* engaged with the landing cam hook 114*a* but slightly higher so that the engagement of the landing cam 112*a* against the landing cam hook 114*a* is causing the landing cam hook 114*a* to raise slightly, thus raising the landing 14 so that the blade edge 32 is positioned a distance from the runway 12 to provide the first smallest thickness T1.

The cam axle 100 may be rotated to a second use position, shown in FIG. 8, so that the runway cam 110 and landing cam 112*a* also rotate. Moving from the first use position to the second position, the runway cam 110 essentially rotates downward, out of the recess 111 and into the runway hook 120 to force the runway hook 120 (and runway 12) downward a small amount relative to a cam axle center of rotation 100*a*, thereby pivoting the runway 12 itself around its pivot recess 50. Simultaneous with this pivoting, the landing cam 112*a* rotates essentially upward to force the landing cam hook 114*a* further upward relative to the axle center 100*a*. This forces the landing 14 to pivot upward around its pivot hooks 70. This upward pivoting by the landing 14 and downward pivoting by the runway 12 increases the distance between the runway 12 and the blade edge 32, resulting in a thickness T2 that is greater than the thickness T1. As noted above, the amount of pivoting of each of the runway 12 and landing 14 is programmed so that the planes of the runway 12 and blade 30 remain substantially parallel, which allows the thickness T2 to be uniform across the lateral breadth of the slice of the food bulk.

Figure 9:
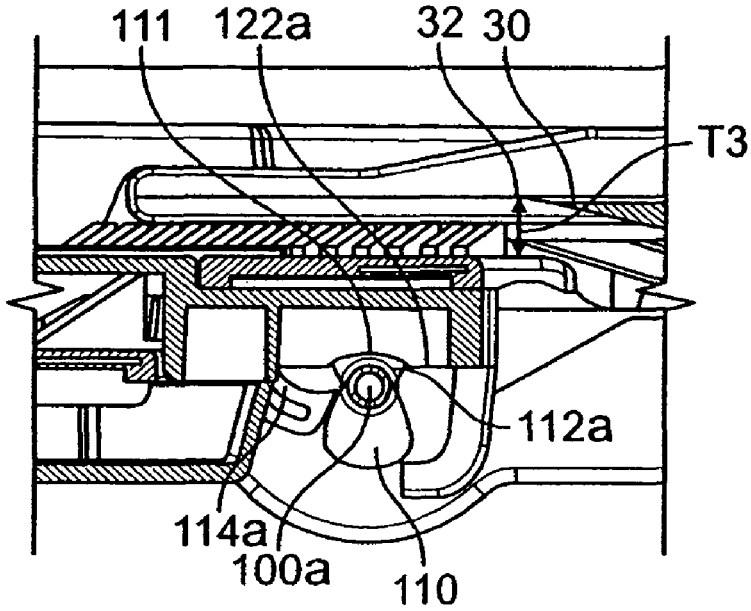
FIG. 9 is a view similar to FIGS. 6-8 showing the cam assembly in a third position use.
Figure 10:
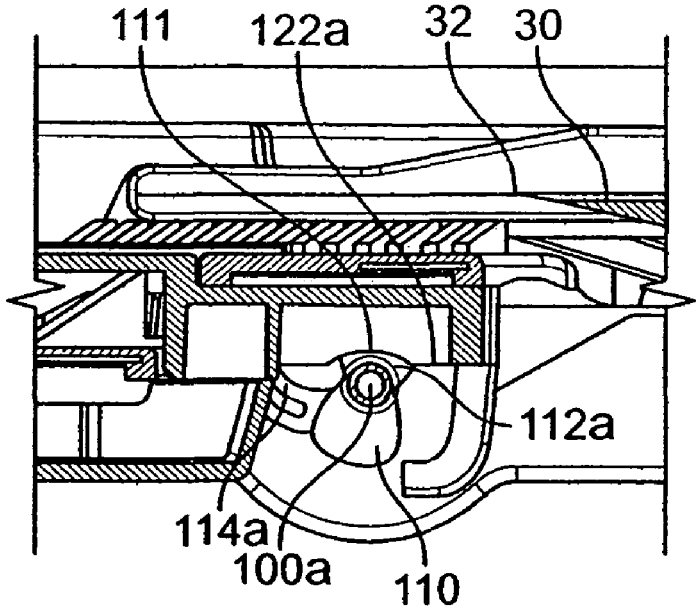
FIG. 10 is a view similar to FIGS. 6-9 showing the cam assembly in a final, release position.

A third use position is represented in FIG. 9 wherein the cam axle 100 is rotated to a third position to further pivot the landing 14 upward and the runway 12 downward. As can be seen, the runway cam 110 is rotated from the position of FIG. 8 so that the runway hook 120 is shifted an additional amount downward relative to the cam axle center 100*a*. The landing cam 112*a* similarly forces the landing 14 upward, relative to the cam axle center 100*a*, so that the thickness T3 is greater than the thickness T2 of FIG. 7. Again, the cams 110, 112 are programmed so that the planes of the runway 12 and the blade 30 remain parallel.

It should be noted that the runway 12 and landing 14 may be relatively pivoted to a plurality of positions intermediate a minimum and maximum thicknesses T, and the positions shown in FIGS. 7-9 are intended merely as representative positions to describe the cooperation of the cam axle 100 and the cams 110, 112.

Lastly, a release position is shown in FIG. 10, whereby the cam 110 is rotated clear of the runway hook 120 and the landing cam 112*a* is clear of the landing cam hook 114*a*. Thus, the runway 12 and landing 14 may be lifted off from the frame 20.

It should be noted that, in reverse operation, the landing cams 112 lower the landing 14 through cooperation and engagement with the landing cam hook 114*a*, and the runway cam 110 raises the runway 12 by camming against the cam surfaces 122*a*, 122*b*.

It should also be noted that the cam axle 100 may be retained in each of these positions. That is, discrete detents may be provided for the cam axle 100 relative to the frame 20 supporting the cam axle 100 so that the positions of the runway 12 and landing 14 are not accidentally or inadvertently shifted during slicing operation of the slicer 10. Additionally, stops (not shown) may be provided to limited the amount of rotation of the cam axle 100, and thus to define end points of a range of thickness T. However, the range of motion of the cam axle 100 may be specified to allow the thickness T to be negative. In other words, the runway 12 and landing 14 may be relatively pivoted so that the blade edge 32 is positioned below the plane of the runway 12, which serves to protect the blade edge 32 during storage and reduces accidental contact therewith by a user's hands when the slicer 10 is being handled without being used to slice a food bulk. In such a position, the runway 12 and landing 14 may be locked, as described herein.

Because the runway 12 is easily pivotable, it can be manually pivoted upward to allow access to its bottom side 12*a*, shown best in FIG. 11. This can be achieved by pressing on the upstream end 44 of the runway 12, which extends slightly beyond the pivot recess 50, or by lifting from the downstream end 64. As such, the runway bottom side 12*a* is easily accessed for use as storage. It should be noted that, instead of the cams as described herein, the knob 16 may be operably connected to the runway 12 and landing 14 via other structures, such as a gearing system.

Figure 12:
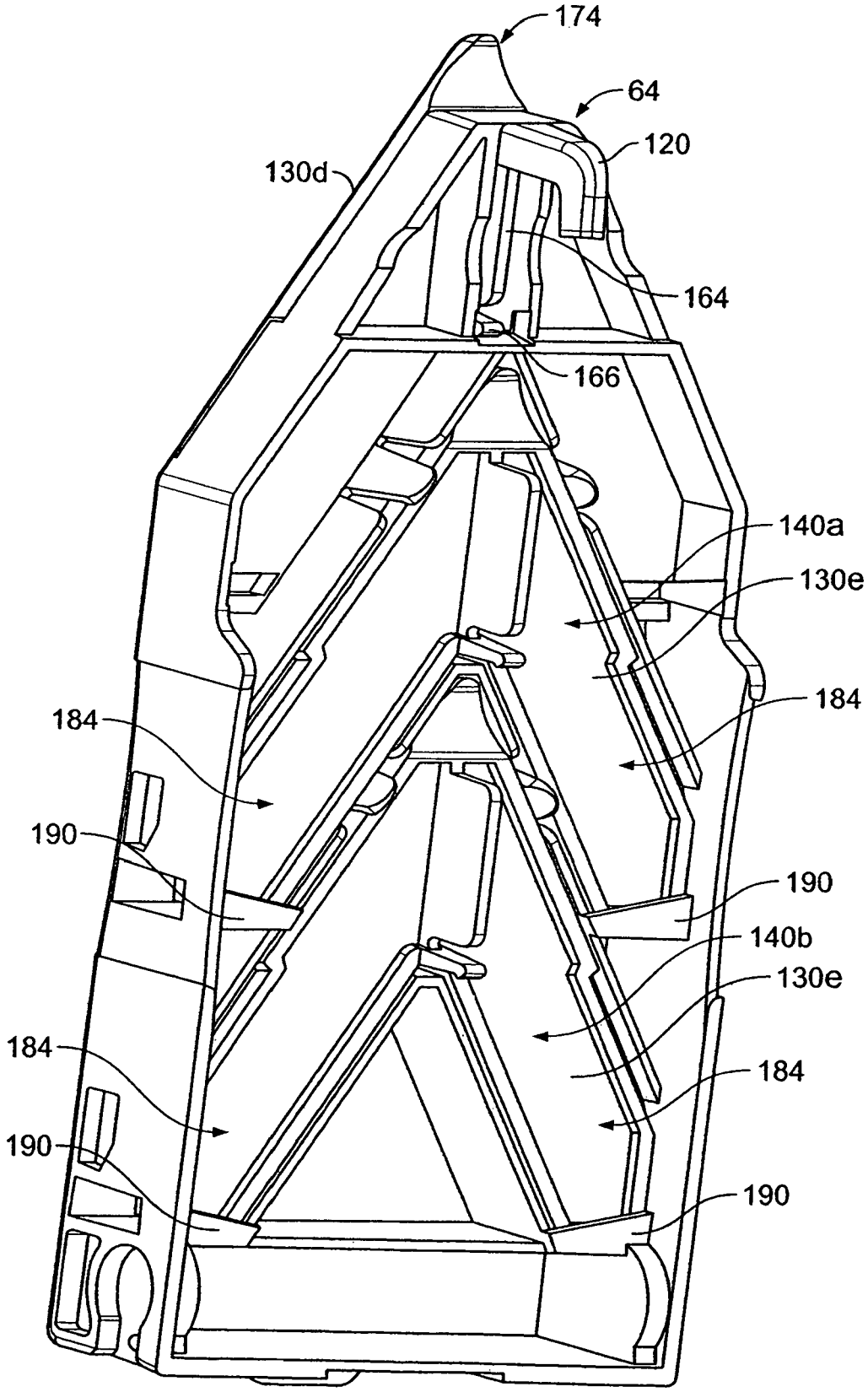
FIG. 12 is a similar view to FIG. 11 showing a first runway insert installed for use on a top side of the runway and releasably received in the runway, and runway inserts stored in the storage bays.

The slicer 10 may be provided with a plurality of runway inserts 130, as shown in FIG. 3, that are selectively secured on a top side 12*b* of the runway 12 and selectively stored with the bottom side 12*a*. FIG. 1 shows a julienne insert 130*a* secured with the top side 12*b* of the runway 12. FIG. 3 shows the julienne insert 130*a*, a basic insert 130*b*, and a cubing insert 130*c*. FIG. 12 shows a first of the runway inserts 130*d* secured on the top side 12*b*, and a other runway inserts 130*e* secured in a first and second storage bays 140*a*, 140*b* on the bottom side 12*a*, any of which inserts 130*d*, 130*e* may be any of the inserts 130*a*, 130*b*, 130*c*. In FIG. 11, the runway 12 is seen having the storage bays 140*a*, 140*b* with no insert 130 secured with the runway 12.

With reference to FIGS. 1 and 3, the julienne insert 130*a* includes vertically standing blades 132 extending upward from the plane of the runway 12. As the food bulk passes across the runway 12, vertical slices are made therein. Once blade 30 passes through the food bulk, the combination of the vertical slices made by the vertical blades 132 and the horizontal blade 32 creates julienne slices of the food bulk. The basic insert 130*b*, shown in FIG. 3, is without significant features on a top surface 134, other than ridges 136 that generally correspond with the ridges 40 of the runway 12. This insert 130*b* allows for simple slices to be made by the slicer 10.

The cubing insert 130*c*, also shown in FIG. 3 also includes vertical blades 138 that have a greater height than the vertical blades 132 of the julienne insert 130*a*. As the food bulk passes over the cubing insert 130*c*, the vertical blades 138 thereof slice into the food generally to a depth that is twice the thickness T for the food slice itself. A first pass over the blades 138 is made in which julienne strips are made that have a height half of the height of the vertical blades 138. The food bulk is the rotated a quarter turn, and directed over the vertical blades 138 a second time. In this manner, a crosshatch or grid pattern is cut into the food bulk, with a first set of slices being the full depth of the vertical blades 138 from the second pass therethrough and a second set of slices being half the depth of the vertical blades 138 from the first pass, half the depth having been removed by the second pass itself. The food bulk is further directed against the horizontal blade 30 so that the blade 30 passes through the food bulk and cuts half the depth of the vertical blades 138. Thus, the food sliced away from the food bulk is formed in cubes. On each subsequent pass through the slicer 10, the food bulk is rotated so that each pass results in slicing cubes from the food bulk that are half the depth of the vertical blades 138.

Figure 13:
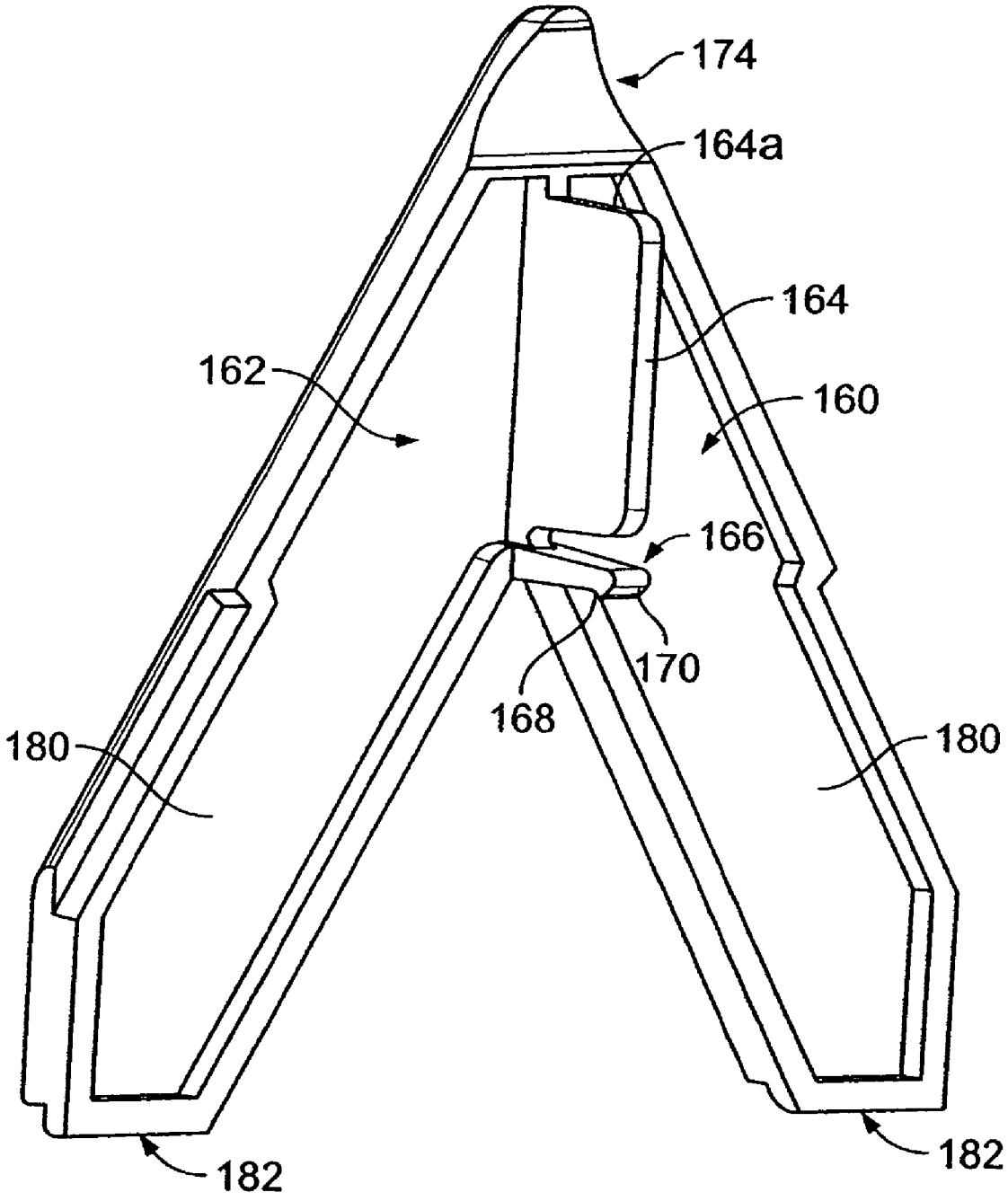
FIG. 13 is a perspective view of a bottom side of a runway insert securable with the runway.

As noted, the inserts 130 may be secured with the top side 12*b* of the runway 12 and stored on the bottom side 12*a* of the runway 12. An opening 150 is formed on the top side of the runway 12*b* (FIGS. 3 and 13) for receiving securing structure 160 formed on a bottom side 162 of an insert 130, as shown in FIG. 13. The securing structure 160 includes a generally rigid tab 164 having a first edge 164*a* that, when secured with the runway 12, contacts a first surface 150*a* within the runway opening 150. The securing structure 160 further includes a resiliently deflectable arm 166 including a finger 168 on a lower end thereof. To insert the securing structure 160 into the runway opening 150, the tab edge 164*a* is placed in contact with the runway opening first surface 150*a*, and a chamfer 170 formed on the finger 168 contacts a second surface 150*b* within the runway opening 150. Force is then applied against the insert 130 so that the chamfer 170 forces the arm 166 and finger 168 inward toward the tab 164. Once the finger 168 passes by the second surface 150*b*, it returns outward so that the finger 168 hooks onto a shoulder 172 (FIG. 11) formed within the opening 150, and above the cam surfaces 122*a*, 122*b* (see FIG. 11). In this manner, the insert 130 is snapped into securement with the runway 12. To release the insert 130, manual pressure is applied to the finger 168 to force the finger 168 toward the tab 164 to position the finger 168 clear of the bottom edge 172, allowing the securing structure 160 to be removed from the opening 150. The insert 130 is generally V-shaped to correspond to the structure of the runway downstream end 64. It should be noted that, in the present embodiment, the insert 130 has a downstream portion 174 that extends beyond the runway downstream end 64, as shown in FIG. 12. This allows the insert 130 and runway 12 to be easily manually pivoted by lifting on the runway downstream portion 174.

Each storage bay 140 allows an insert 130 to be snapped into a storage position. As a result of the V-shape, the insert 130 has a pair of legs 180, each of which has an end 182. Each storage bay 140 is generally V-shaped to have leg openings 184 corresponding to each of the insert legs 180. At an end 188 of each leg opening 184, a short wall 190 is formed that extends over and somewhat closes the opening end 188. Along the sides of the leg openings 184 are resiliently deflectable arms 192 having fingers 194 formed thereon. To store an insert 130 in one of the storage bays 140, the insert legs ends 182 are first positioned within the leg openings 184 within the walls 190, and the insert 130 is then rotated toward the arms 192. The insert 130 is then pressed against the fingers 194 so that the arms 192 are forced outward to allow the insert 130 to pass. Once the insert 130 is fully positioned within the openings 184, the arms 192 are free to return toward their natural position so that the fingers 194 are in interference positions with the bottom side 162 of the insert 130. To release the insert 130, the tab 164 is pulled outward thereby forcing the arms 192 outward and clear of the insert 130.

With the provided construction, the inserts 130 may be easily accessed, stored, and selectively secured with the runway 12. During operation of the slicer 10, it may be desirable to change the insert 130 to change the operation. By allowing the runway 12 to be pivoted upward, the entire slicer 10 need not be rotated to change the insert 130. Additionally, the on-board storage provides positive structure for retaining the inserts 130, minimizing risk of the inserts 130 becoming separated from the slicer 10 or lost, and does so without increasing the size of the slicer 10.

As noted above, the V-shaped blade 30 may be secured with the landing 14 on a top side thereof for use. It should be noted that the blade 30 is, preferably, secured within a blade cartridge 230, and the cartridge 230 may secured to the top side of the landing 14 for use, and secured with a bottom side of the landing 14 for storage. With reference to FIG. 3, a blade cartridge 230*a* is shown in an orientation for being secured with the landing 14 in a cartridge seat 232 on the top side thereof, and a second blade cartridge 230*b*, upside down relative to blade cartridge 230*a*, is shown in a position for being secured on a bottom side of the landing 14.

Figure 15:
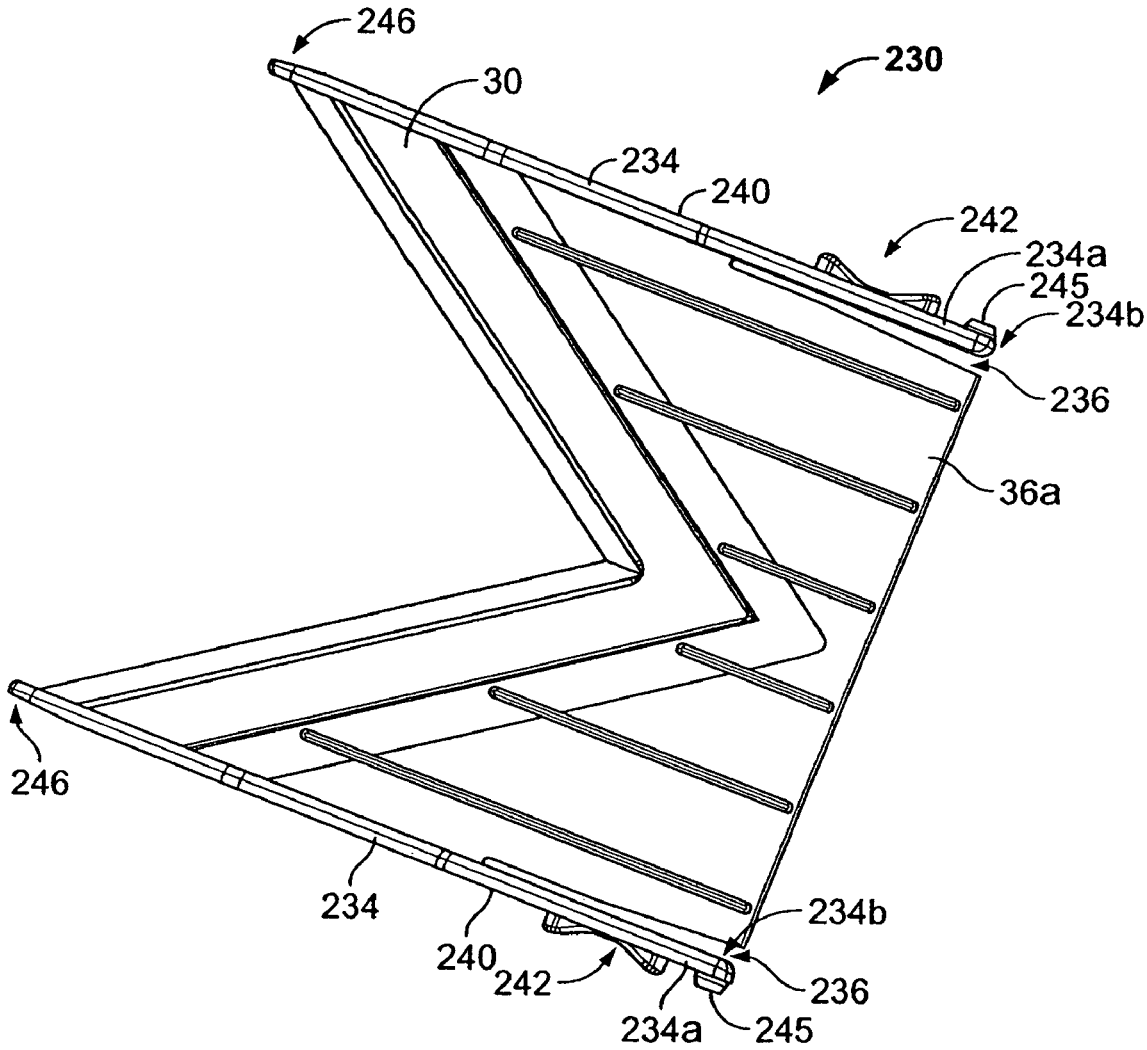
FIG. 15 is a perspective view of a blade cartridge.

As can be seen in FIG. 15, the blade cartridge 230 includes a portion 36*a* of the deck 36 of the landing 14, as shown in FIG. 1. The blade cartridge 230 carries the blade 30 at its upstream end 34, as described above. As can be seen in FIGS. 3 and 15, sidewalls 234 extend upwardly from the deck portion 36*a* which, when secured on the top of the landing 14 in the cartridge seat 232, are received within the side frames 82. A downstream portion 234*a* of each sidewall 234 is resiliently shiftable by virtue of a slot 236 formed in the deck portion 36*a*, best seen in FIG. 15. In this manner, the downstream portions 234*a* may be easily compressed (such as by a forefinger and thumb). An outside surface 240 on each of the downstream portions 234*a* includes an outwardly extending finger grip 242 for doing so. A rear or terminal portion 234*b* of each sidewall 234 includes an outwardly extending tab 245 that shifts along with its respective downstream portion 234*a*.

To secure the blade cartridge 230 with the cartridge seat 232, front tips 246 of the sidewalls 234 are placed into recesses 250 formed in the side frames 86 (see FIGS. 1, 3, and 4), and the blade cartridge 230 is then rotated downward around the front tips 246 until the blade cartridge 230 comes in contact with the top surface of the cartridge seat 232. During this time, the downstream sidewall portions 234*a* are compressed inwardly by gripping the finger grips 242. This allows the tabs 245 to be shifted inwardly. Once seated, the finger grips 242 are released so that the downstream sidewall portions 234*a* and the tabs 245 resiliently shift outwardly, the tabs 245 thus shift into tab recesses 260 (FIG. 3) formed in the side frames 82, and the finger grips 242 shift into access recesses 262 (FIG. 3) formed in the side frames 82.

Figure 14:
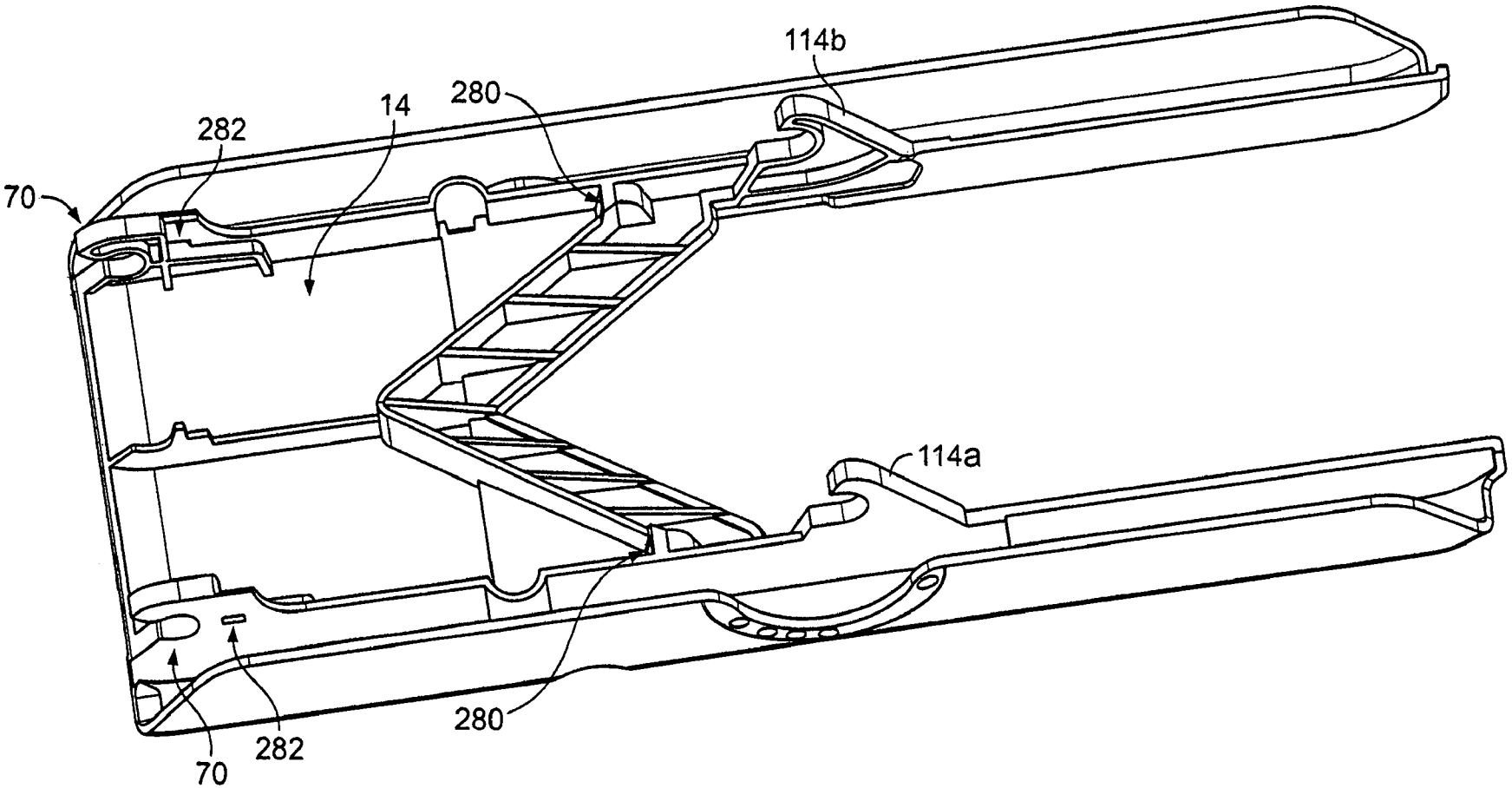
FIG. 14 is a perspective view of a bottom side of a portion of the slicer showing a bottom side of the landing having structure for receiving a blade cartridge.

A similar operation is performed to secure the blade cartridge 230 on the bottom of the landing 14. With reference to FIG. 14, a tip recess 280 is provided for each of the cartridge front tips 246, and a tab recess 282 is provided for each tab 245. The finger grips 242 are used to compress the downstream sidewall portions 234*a* and the tabs 245, the front tips 246 are inserted into the tip recesses 280, the cartridge 230 is rotated downward against the bottom of the landing 14, and the tabs 245 are aligned with the tab recesses 282. The finger grips 242 are then released, thereby allowing the tabs 245 to shift outwardly and into the tab recesses 282.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A food slicer for slicing food advanced in a cutting direction comprising:

a slicing blade oriented generally transverse to the cutting direction having a blade edge;

a landing for receiving food after the food passes over the blade edge;

an insert;

a runway for supporting food prior to the food passing over the blade edge, the runway including structure for retaining the insert on a top side of the runway, the structure permitting removal of the insert therefrom for replacement of the insert; and a storage bay for storing the insert, wherein the storage bay is located on a bottom portion of the food slicer, the bottom portion being movable relative to the food slicer to allow access to the storage bay from a top side of the food slicer, and wherein the storage bay includes resiliently deflectable retention portions for releasably securing the insert in the storage bay.

2. The food slicer of claim 1 wherein the insert includes a set of blades oriented generally orthogonal to the slicing blade.

3. A food slicer for slicing food advanced in a cutting direction comprising:

a slicing blade carried on a blade cartridge, the slicing blade having a blade edge;

a landing for receiving food after the food passes over the blade edge;

an insert;

a runway for supporting food prior to the food passing over the blade edge, the runway including structure for retaining the insert on a top side of the runway, the structure permitting removal of the insert therefrom for replacement of the insert;

a storage bay for storing the insert, wherein the storage bay is located on a bottom portion of the food slicer, the bottom portion being movable relative to the food slicer to allow access to the storage bay from a top side of the food; and a storage for storing the blade cartridge located on the bottom portion of the food slicer.

* * * * *